United States Patent [19]

Gate et al.

[11] Patent Number: 4,955,815

[45] Date of Patent: Sep. 11, 1990

[54] CONNECTION SOCKET, IN PARTICULAR TO CONNECT COAXIAL PLUG, WITH FRONT MOUNTING

[75] Inventors: Hubert Gate, Tierce; Dominique Huerre, Angers, both of France

[73] Assignee: Societe Electronique de la Region Pays de Loire, Paris, France

[21] Appl. No.: 360,144

[22] Filed: Jun. 1, 1989

[30] Foreign Application Priority Data

Jun. 3, 1988 [FR] France ..... 8807406

[51] Int. Cl.[5] ..... H01R 13/627

[52] U.S. Cl. ..... 439/350; 248/27.3; 439/557

[58] Field of Search ..... 439/350, 357, 374, 544, 439/552, 553, 557, 668, 669, 675, 278, 353; 248/27.1, 27.3; 200/295, 296

[56] References Cited

U.S. PATENT DOCUMENTS

| | | | |
|---|---|---|---|
| 3,435,163 | 3/1969 | Bailey et al. . | |
| 3,594,696 | 7/1971 | Witek | 439/278 |
| 4,721,478 | 1/1988 | Sonolse | 439/278 |
| 4,731,925 | 3/1988 | Tanishi et al. | 200/296 |

FOREIGN PATENT DOCUMENTS

| | | |
|---|---|---|
| 1515440 | 7/1969 | Fed. Rep. of Germany . |
| 1640926 | 2/1971 | Fed. Rep. of Germany . |
| 3242077 | 5/1984 | Fed. Rep. of Germany . |

*Primary Examiner*—Eugene F. Desmond
*Assistant Examiner*—Walter G. Hanchuk
*Attorney, Agent, or Firm*—Oblon, Spivak, McClelland, Maier & Neustadt

[57] ABSTRACT

The socket of the invention is provided with tappets that are snapped into slots made in partition walls perpendicular to the fixing front. To adjust the clearances, elastic surfaces are formed on the forward face.

3 Claims, 1 Drawing Sheet

CONNECTION SOCKET, IN PARTICULAR TO CONNECT COAXIAL PLUG, WITH FRONT MOUNTING

BACKGROUND OF THE INVENTION

1. Field of the Invention

An object of the present invention is a connection socket to connect, in particular, coaxial plugs with front mounting.

2. Description of the Prior Art

To fix a connection socket for a coaxial plug, such as a plug for stereophonic headphones, on the front of an instrument such as a television set or a video recorder set, this socket is generally provided with an externally threaded sleeve, and then the fixing is done by screwing a nut on to the sleeve from the outside. Depending on the thickness of the walls, sleeves of different lengths have to be provided for. It is hard to robotize the fixing of sockets such as this, and different sockets have to be provided for, if they are fitted into fronts of different thicknesses.

SUMMARY OF THE INVENTION

An object of the present invention is a connection socket of the above-mentioned type, which can be easily fixed, even by a robot, and which can be manufactured in a single model for being fixed to partitions of different thicknesses.

The socket according to the invention has at least one snap-fastened tappet working with a slot made in a wall parallel to the axis of the socket, said wall being elastic at least in the zone of the slot. Advantageously, the body of the socket is made of plastic material and is molded with a smooth sleeve.

Advantageously, at least one elastic surface is formed on the front face of the socket.

BRIEF DESCRIPTION OF THE DRAWING

The present invention will be better understood from the following detailed description of an embodiment, taken as a non-restrictive example and illustrated by the appended drawing, wherein.

DESCRIPTION OF A PREFERRED EMBODIMENT

Figure 2:
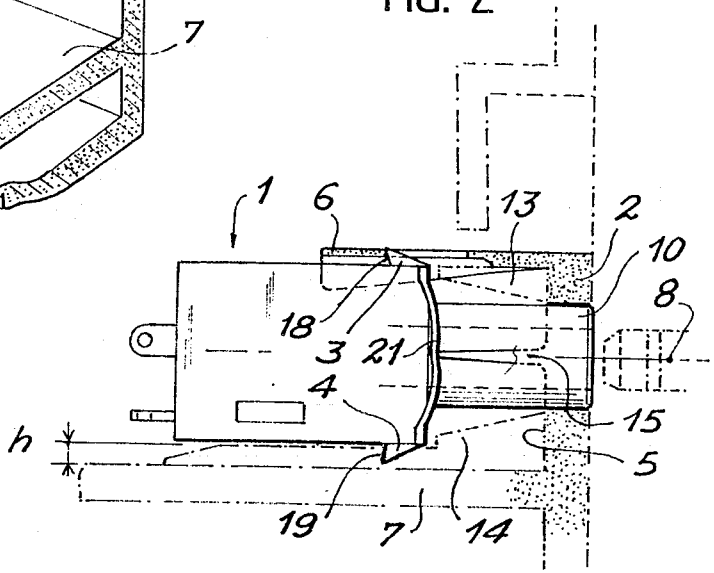
Figure 1:
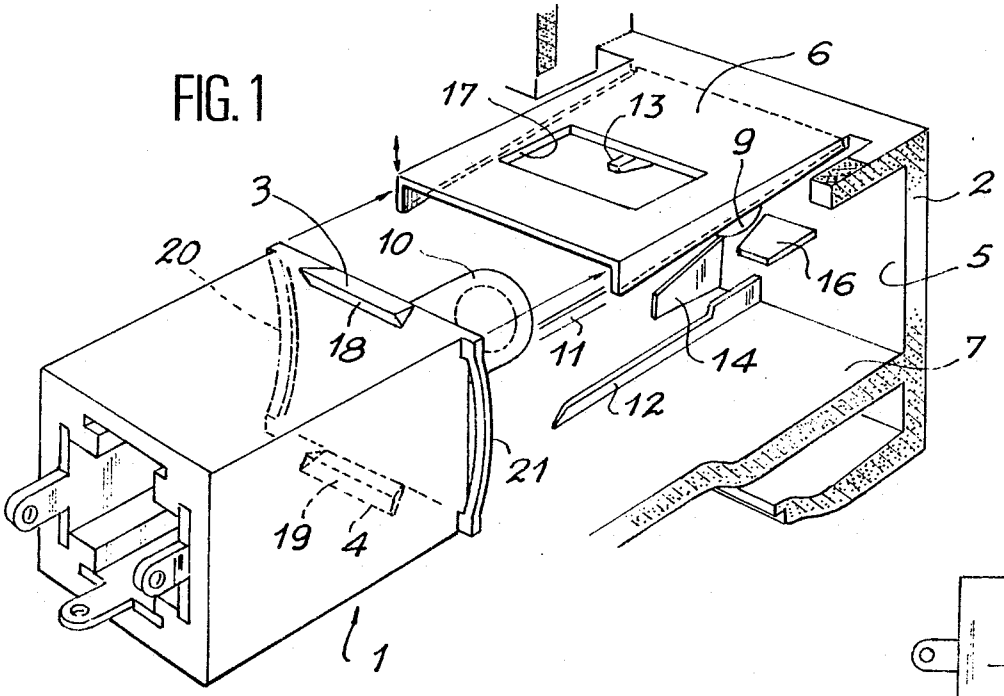
FIG. 1 shows an exploded perspective view of a socket according to the invention, and of the wall on which it has to be fixed and, FIG. 2 shows a side view of the socket of FIG. 1

The present invention is described below with reference to a socket for a headphone connector, but it is understood that it can be applied to other types of sockets, for example for the connection of microphone plugs, mains supply plugs for portable machines etc.

The socket 1 shown in the drawing is designed to be fixed to a front 2, for example, the front of a television receiver set.

In the present case, the socket 1 has a parallelepiped shaped body having a square cross section. The socket 1 has, in the front part of its body and on two opposite faces, transversal tappets, 3, 4, extending over almost the entire width of these faces. On the rear face 5 of the front 2, are formed two plane walls 6, 7, perpendicular to the face 5, arranged symmetrically with respect to the axis 8 of the hole 9 of the front 2 through which the sleeve 10 of the socket 1 must pass. The distance between the partitions 6, 7, is substantially equal to the distance between the edges of the tappets 3, 4. To guide and hold the socket 1 between the partitions 6, 7, two ribs 11, 12, are formed on the partition 7. These ribs 11, 12 are perpendicular to this partition, and parallel to the axis 8, and symmetrical with respect to this axis. The length of these ribs 11, 12, is roughly equal to the length of the socket 1 and of its sleeve 10. Their height h is substantially equal to the height of the tappets 3, 4 (the height of the tappets is taken to be the distance between their edges and the face on which these tappets are formed). The distance between the ribs 11, 12, is substantially equal to the length of the tappets 3, 4.

Furthermore, on the face 5, around the hole 9, four ribs 13 to 16 are formed. These four ribs 13 to 16 are perpendicular to this face and parallel to the axis 8. The ribs 13 and 14 are coplanar and are also formed on the partitions 6 and 7 respectively, and are perpendicular to them. The ribs 15 and 16 are coplanar, and their median common plane is perpendicular to the median plane of the ribs 13, 14. These two planes intersect along a straight line that is identical with the axis 8. The length of the ribs 13 to 16 is practically equal to the length of the sleeve 10 minus the thickness of the wall 2. These ribs are flush with the hole 9 and their edges bordering this hole form an acute angle of about 10° to 20°, opening out rearwards, with the axis 8. Thus, these ribs 13 to 16 are used, firstly, to guide the sleeve 10 into the hole 9 and, secondly, as stops for the front face (the face whence the sleeve 10 projects) of the socket 1. Thus, for different applications, it is possible to use only one type of socket with a sleeve having only one length, greater than the maximum foreseeable wall thickness for the fixing of this socket.

The tappet 3 works together with a corresponding slot 17 formed in the wall 6. To prevent any undesirable dismantling of the socket, the rear faces 18, 19 of the tappets 3, 4, form an acute angle, that opens out rearwards, with the axis 8 and with each other. Thus, if the socket 1 is forced backwards, the face 18 or 19 of one of the tappets acts in the direction wherein the blocking of the tappet in the slot 17 is reinforced. In the embodiment shown in the drawing, only the wall 6, which is slightly elastic, has a snap-in slot, but it is understood that the second wall 7, which is relatively rigid and has no snap-in slot in the present embodiment, could be also be slightly elastic and could have a snap-in slot.

To prevent any play of the socket in a fixed position, two elastic, curved straps 20, 21 are formed on its forward face or near this face. These two straps are slightly crushed by the ribs 15, 16, when the socket is snapped in These straps can easily be molded with the socket.

To enable easy snapping in of the socket 1, as well as it deliberate dismantling, the partition 6 is formed so as to be elastic at least in the zone bordering the slot 17. Advantageously, this partition is thin (with a thickness of about 1 mm.) but not too thin so that it remains sufficiently resistant. To dismantle the socket 1 at will, it is enough to cause the socket 1 to exert slight pressure against the front 2, thus further crushing the straps 20, 21, and sufficiently release the rear faces 18, 19, of the tappets 3, 4, to enable the partition 6 to be moved away and the socket to be removed.

The above described socket 1 has two tappets, but is clearly understood that only one tappet would be enough and that, in this case, the distance between the partitions 6 and 7 would be reduced accordingly.

What is claimed is:

1. A connection socket means for connection of a coaxial plug through an exterior wall of a structure by a hole in said structure wall, said means comprising:

at least one plane wall formed on the interior surface of said structure wall and perpendicular to said structure wall, said at least one plane wall having a slot and said at least one plane wall being flexible in the zone of said slot;

a connector socket having a body including at least one snap-fastened tappet cooperating with said at least one slot to retain said connection socket, said connection socket further including a smooth sleeve extending along a first axis outward from said body;

a guide means including a plurality of ribs formed on said interior surface of said structure wall in proximity to said hole for aligning said smooth sleeve in conjunction with said hole and wherein said ribs are formed so that said smooth sleeve is fitted in said hole with one end of said smooth sleeve being substantially in the same plane as the exterior surface of said structure wall.

2. The connection socket means according to claim 1, wherein said body of said connector socket further includes an elastic surface formed on the side of said body from which said smooth sleeve extends.

3. The connection socket means according to claim 2, wherein the rear face of each of said at least one tappet forms an acute angle, opening out rearwards with said first axis.

* * * * *